US010000320B2

(12) United States Patent
Gagne

(10) Patent No.: US 10,000,320 B2
(45) Date of Patent: Jun. 19, 2018

(54) WINE CORK WITH BUILT-IN GAS ACTIVATED MINI-CORKSCREW

(71) Applicant: John Paul Gagne, Old Saybrook, CT (US)

(72) Inventor: John Paul Gagne, Old Saybrook, CT (US)

( * ) Notice: Subject to any disclaimer, the term of this patent is extended or adjusted under 35 U.S.C. 154(b) by 353 days.

(21) Appl. No.: 15/040,656

(22) Filed: Feb. 10, 2016

(65) Prior Publication Data

US 2016/0264322 A1 Sep. 15, 2016

Related U.S. Application Data

(60) Provisional application No. 62/133,192, filed on Mar. 13, 2015.

(51) Int. Cl.
*B65D 39/00* (2006.01)
*B65D 51/24* (2006.01)

(52) U.S. Cl.
CPC ..... *B65D 51/243* (2013.01); *B65D 39/0052* (2013.01); *B65D 39/0058* (2013.01)

(58) Field of Classification Search
CPC ..... B65D 51/243; B65D 51/221; B65D 39/0058; B65D 39/0052
USPC ..... 215/296, 297, 355, 364
See application file for complete search history.

(56) References Cited

U.S. PATENT DOCUMENTS 2,729,124 A * 1/1956 Farandatos ..... B67B 7/08 222/5
3,085,454 A * 4/1963 Federighi ..... B67B 7/08 141/329
3,135,410 A * 6/1964 Federighi ..... B65D 39/00 215/227
3,815,448 A * 6/1974 Artmer ..... B67B 7/0405 81/3.2

* cited by examiner

*Primary Examiner* — Andrew T Kirsch
*Assistant Examiner* — Don M Anderson
(74) *Attorney, Agent, or Firm* — Plager Schack LLP

(57) ABSTRACT

Some embodiments of the present disclosure include a bottle cork with a built-in removal mechanism. The bottle cork may include a cork body having a hollow sleeve positioned therein, the hollow sleeve housing a mini-corkscrew, the mini-corkscrew having a corkscrew end extending toward a bottom surface of the cork body and an end opposite the corkscrew end; a gas cartridge configured to be punctured by the end of the mini-corkscrew opposite the corkscrew end; and a knob top attached to the gas cartridge, such that when the knob top is rotated, the gas cartridge is pierced by the end of the mini-corkscrew opposite the corkscrew end while the corkscrew end is drawn into and through the bottom surface of the cork body. The pressure exerted by the pierced gas cartridge may force the bottle cork out of a bottle, thus negating the need for an external cork removal tool.

10 Claims, 5 Drawing Sheets

FIG.1
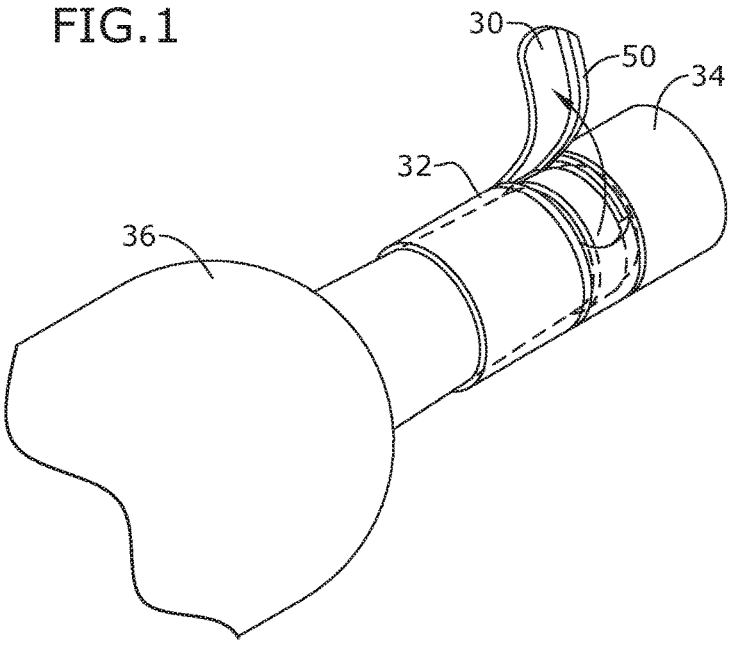
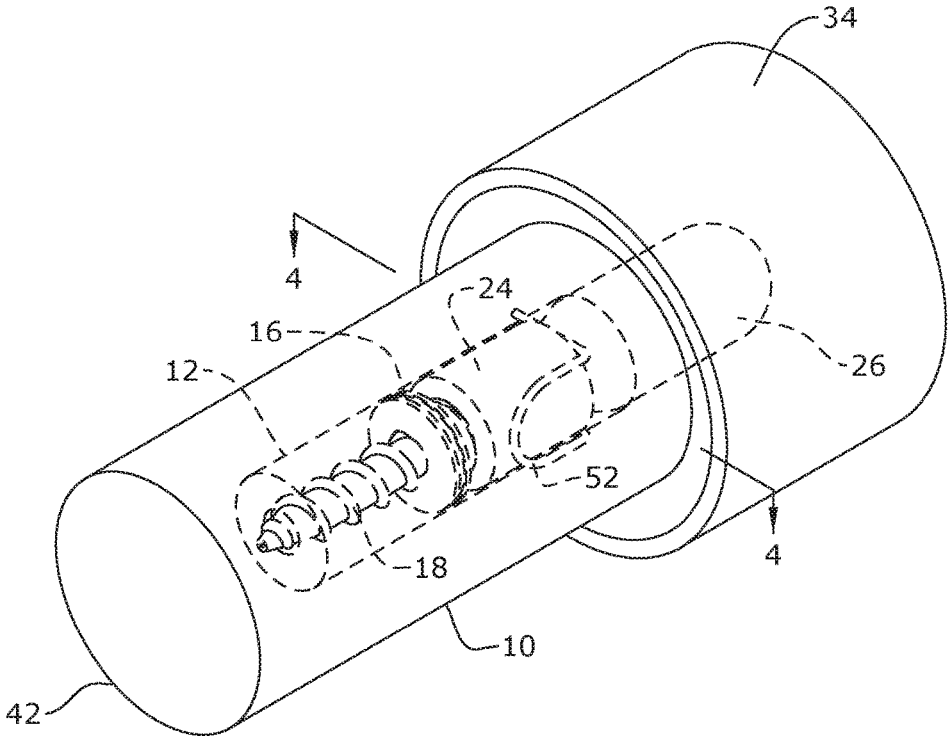
FIG.2

FIG.6
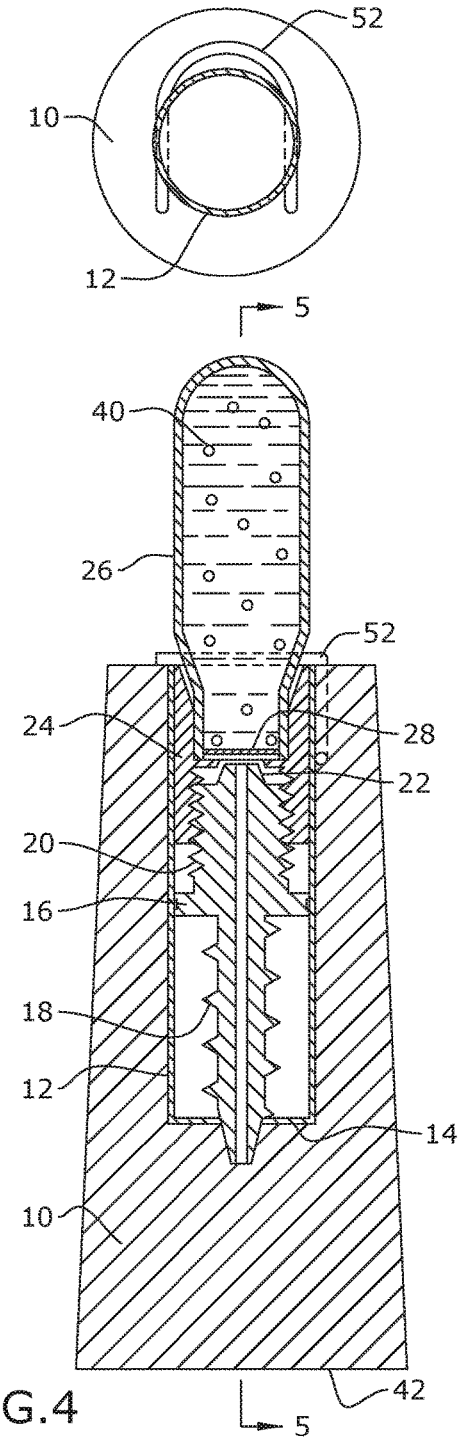
FIG.4
FIG.7
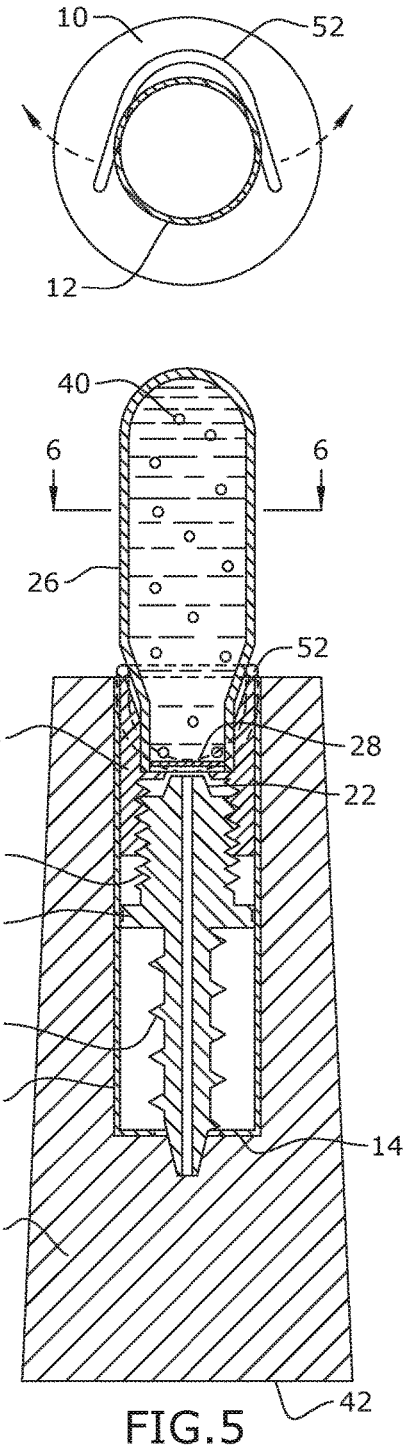
FIG.5

WINE CORK WITH BUILT-IN GAS ACTIVATED MINI-CORKSCREW

RELATED APPLICATION

This application claims priority to provisional patent application U.S. Ser. No. 62/133,192 filed on Mar. 13, 2015, the entire contents of which is herein incorporated by reference.

BACKGROUND

The embodiments herein relate generally to bottling, and more particularly, to a wine cork with a built-in, gas activated mini-corkscrew.

Bottled beverages, such as wine, that are sealed with a cork require a tool, such as a corkscrew, to remove the cork and access the beverage. To avoid the requirement of a corkscrew, some beverage companies use screw tops or other alternative closures that are not made of cork. However, these types of sealing mechanisms require special bottles and machinery.

Therefore, what is needed is a cork with a built-in mechanism for removing the cork from the bottle, such that an external tool is not required to open the corked bottle.

SUMMARY

Some embodiments of the present disclosure include a bottle cork with a built-in removal mechanism. The bottle cork may include a cork body having a hollow sleeve positioned therein, the hollow sleeve housing a mini-corkscrew, the mini-corkscrew having a corkscrew end extending toward a bottom surface of the cork body and an end opposite the corkscrew end; a gas cartridge configured to be punctured by the end of the mini-corkscrew opposite the corkscrew end; and a knob top attached to the gas cartridge, such that when the knob top is rotated, the gas cartridge is pierced by the end of the mini-corkscrew opposite the corkscrew end while the corkscrew end is drawn into and through the bottom surface of the cork body. The pressure exerted by the pierced gas cartridge may force the bottle cork out of a bottle, thus negating the need for an external cork removal tool.

BRIEF DESCRIPTION OF THE FIGURES

The detailed description of some embodiments of the invention is made below with reference to the accompanying figures, wherein like numerals represent corresponding parts of the figures.

FIG. 1 is a perspective view of one embodiment of the present disclosure, shown in use.

FIG. 2 is a perspective view of one embodiment of the present disclosure.

FIG. 4 is a section view of one embodiment of the present disclosure, taken along line 4-4 in FIG. 2.

FIG. 5 is a section view of one embodiment of the present disclosure, taken along line 5-5 in FIG. 4.

FIG. 6 is a section view of one embodiment of the present disclosure, taken along line 6-6 in FIG. 5.

FIG. 7 is a section view of one embodiment of the present disclosure.

Figure 3:
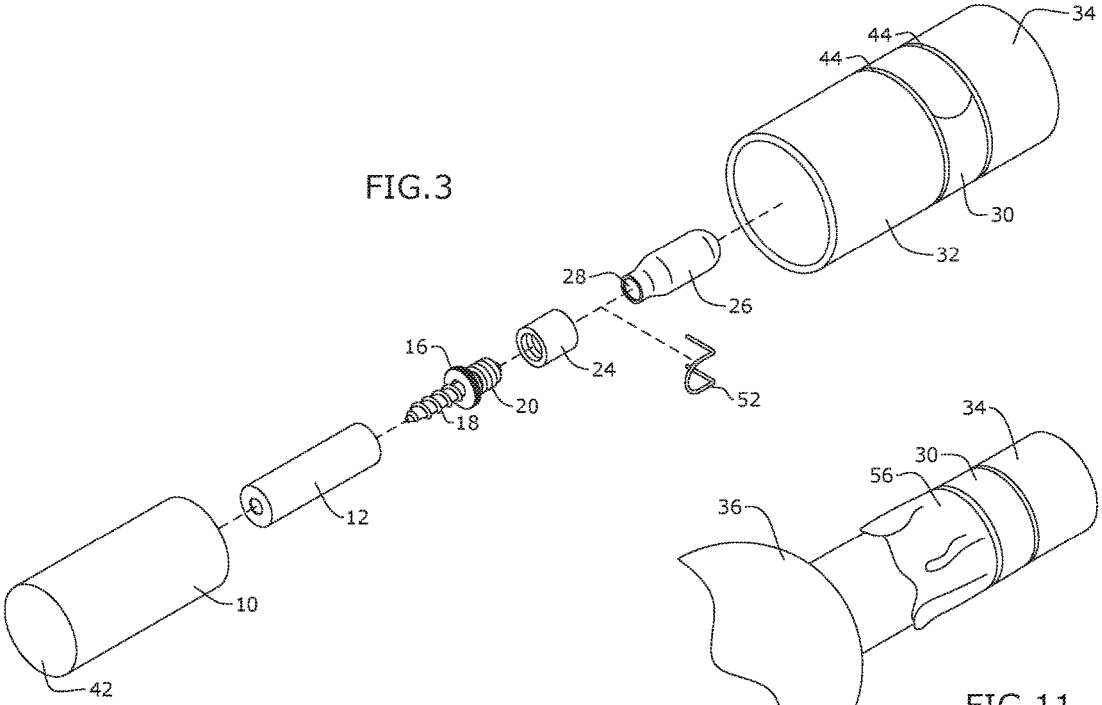
FIG. 3 is an exploded view of one embodiment of the present disclosure.
Figure 11:
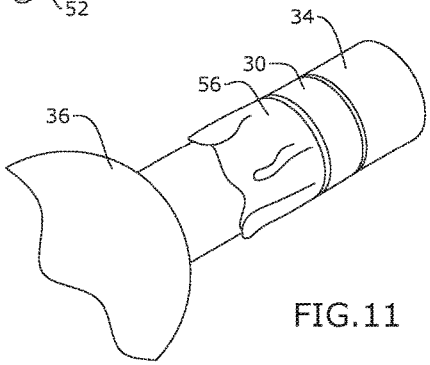
FIG. 11 is a perspective view of one embodiment of the present disclosure.
Figure 8:
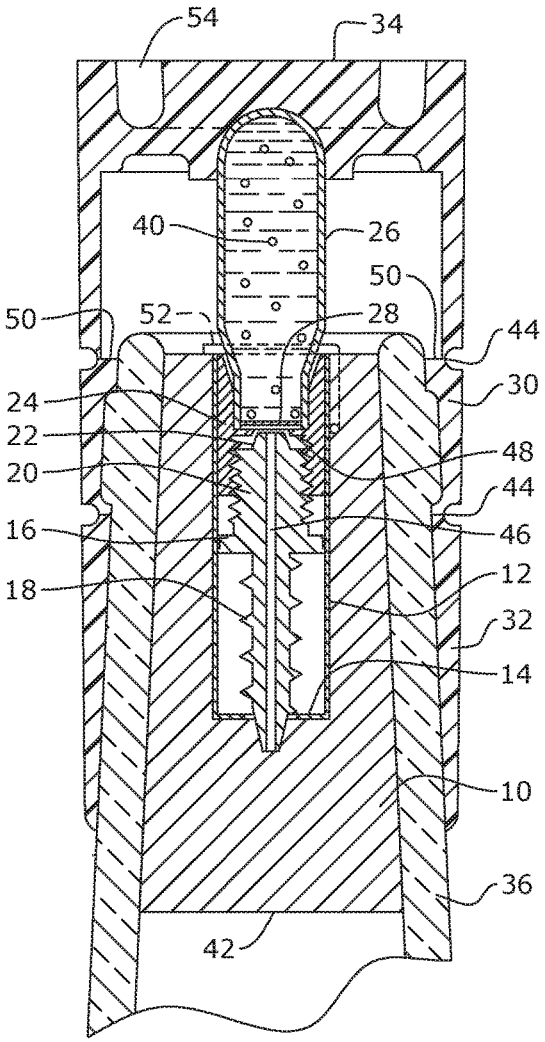
FIG. 8 is a section view of one embodiment of the present disclosure.
Figure 10:
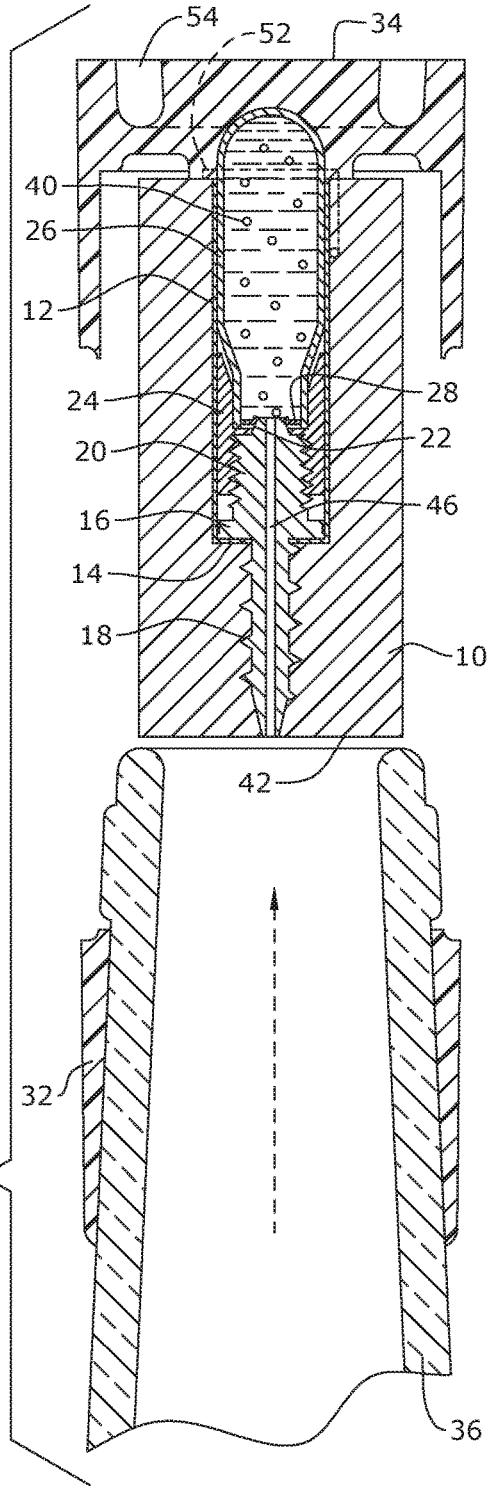
FIG. 10 is a section view of one embodiment of the present disclosure.
Figure 9:
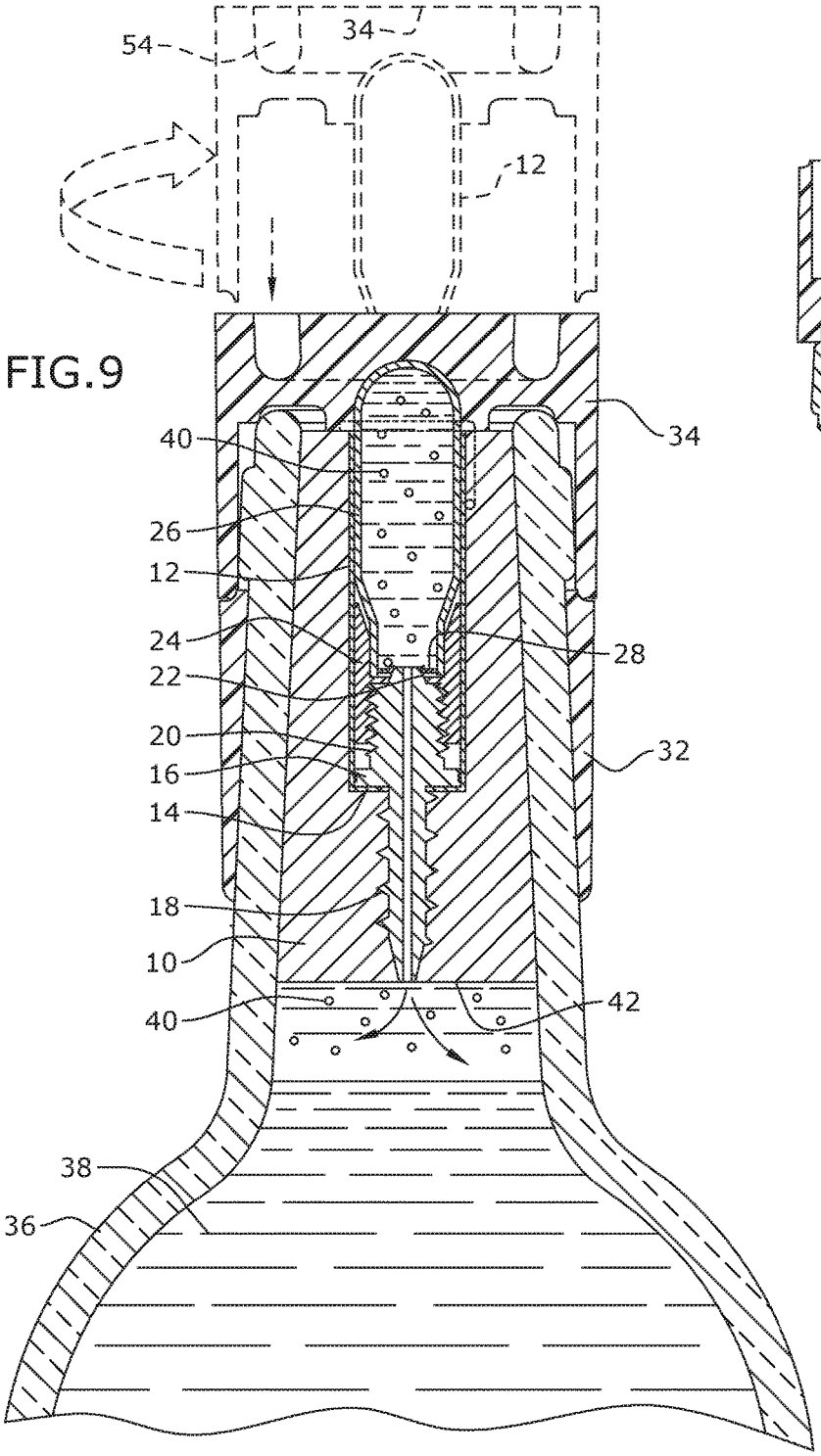
FIG. 9 is a section view of one embodiment of the present disclosure.

DETAILED DESCRIPTION OF CERTAIN EMBODIMENTS in the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to seal a bottle and open the bottle and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Cork
2. Mini-Corkscrew
3. Gas Cartridge
4. Knob Top

The various elements of the device of the present disclosure may be related in the following exemplary fashion. It is not intended to limit the scope or nature of the relationships between the various elements and the following examples are presented as illustrative examples only.

By way of example, and referring to FIGS. 1-12, some embodiments of the present disclosure include a bottle cork with a built-in removal mechanism, the bottle cork comprising a cork body 10 having a substantially hollow sleeve 12 positioned therein, the hollow sleeve 12 configured to accommodate a mini-corkscrew 16 comprising a corkscrew end 18 extending toward an interior of a bottle 36 within the hollow sleeve 12, a gas cartridge 26 configured to be pierced by an end of the mini-corkscrew 16 opposite the corkscrew end 18, and a knob top 34 attached to the gas cartridge 26, such that when the knob top 34 is rotated, the gas cartridge 26 is pierced while the corkscrew end 18 is drawn into the cork body 12 toward a bottom surface 42 of the cork body 16, wherein the pressure exerted by the pierced gas cartridge 26 may force the bottle cork out of the bottle 36.

As shown, for example, in FIG. 3, the bottle cork may comprise a cork body 10 with a bottom surface 42, wherein the bottom surface 42 is initially positioned proximate to a beverage 38 in a bottle 36. The cork body 10 may comprise a substantially hollow channel extending partially there through, the channel being configured to accommodate a sleeve 12 having an orifice in a bottom surface thereof. Before use, the bottle cork may include a mini-corkscrew positioned within the sleeve 12, as shown in FIG. 4. The mini-corkscrew 16 may comprise a corkscrew end 18 positioned proximate to the cork body 10 at the bottom of the sleeve cavity 14 and a threaded end 20 with a puncture nipple 22 opposite the corkscrew end 18. The threaded end 20 may be configured to engage with a threaded collar 24 attached to a gas cartridge 26, such that before use, there is a space present between the threaded end 20 and a gas cartridge seal 28 on the gas cartridge 26. An end of the gas cartridge 26 distal from the mini-corkscrew 16 may be attached to a knob top 34, such that when the knob top 34 is rotated, the gas cartridge 26 and subsequently the threaded collar 24 rotate, causing the threaded collar 24 to be screwed onto the threaded end 20 of the mini-corkscrew 16. When the knob top 34 is fully rotated, the puncture nipple 22 on the threaded end 20 may be configured to pierce the gas cartridge seal 28. In some embodiments, the threaded end 20 may comprise a corkscrew stop 48 configured to prevent the mini-corkscrew 16 from continuing to be threaded through the threaded collar 24 and into the gas cartridge 26. The pressure caused by the gas 40 exiting the gas cartridge 26 may force the bottle cork out of the bottle 36 and into a user's hand.

Some embodiments of the bottle cork may further comprise a safety clip 52 securing the sleeve 12, the threaded collar 24, and the mini-corkscrew 16 within the cork body 10. For example, the safety clip 52 may comprise a substantially U-shaped clip, wherein the clip is bent at an approximate 90° angle partway down each of the arms of the U-shape, as shown in FIG. 3. The arms of the U-shape may be positioned on a surface of the threaded collar 24 and sleeve 12 proximate to the gas cartridge 26, while the rounded portion of the U-shape may extend downward into the cork body 10. The safety clip 52 may prevent the mini-corkscrew 16, sleeve 12, and threaded collar 24 from exiting an end of the cork body 10 proximate to the knob top 34. As shown in FIG. 6, the arms of the safety clip 52 may initially be substantially parallel to one another, but during use of the mini-corkscrew 16 within the bottle cork, the arms of the safety clip 52 may move away from one another, as shown in FIG. 7.

Figure 12:
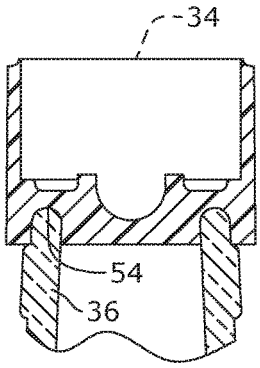
FIG. 12 is a perspective view of one embodiment of the present disclosure.

Embodiments of the bottle cork may also comprise a countersunk sealer 54 in a top surface of the knob top 34, wherein the countersunk sealer 54 functions to reseal a bottle 36 after the cork has been removed. As shown in FIG. 12, the bottle cork may be removed and inverted, such that the countersunk sealer 54 may accommodate the upper portion of the neck of the bottle 36 to reseal an unfinished bottle 36. Thus, the countersunk sealer 54 may comprise a substantially circular notch carved into a top surface of the knob top 34. FIG. 12 only shows the knob top 34 portion of the device; however, in embodiments, the knob top 34 is not removable from the rest of the bottle cork and, thus, the cork body 10 may extend upwards from the bottle 36 when the countersunk sealer 54 is being used the seal the bottle 36.

As shown in the Figures, the knob top 34 may be removably sealed to the outer surface of the bottle 36. For example, a decorative skirt 32 (or an alternate version of a decorative skirt 56) with a tear tab 30 may extend from the knob top 34 down a length of the neck of the bottle 36. To detach the decorative skirt 32, 56 from the knob top 34, the tear tab 30 may be pulled away from the neck of the bottle 36, as shown in FIG. 1. Perforated edges 44 may help ensure that the tear tab 30 is easily removed. Once the tear tab 30 is removed, the knob top 34 may be detached from the skirt 32, 56, allowing the knob top 34 to be rotated to activate the bottle cork. In some embodiments, such as that shown in FIG. 4, the tear tab 30 may comprise inner ridges 50 configured to conform to the shape of the bottle's neck.

As described above, the bottle cork of the present invention may comprise a gas-activated mini-corkscrew built within an actual cork such that a removal tool, such as an electric or manual external corkscrew is not needed to remove the cork from the bottle. The bottle cork of the present disclosure may be inserted into a bottle 36, such as a standard or specialty wine bottle, with a standard cork machine, Specifically, the cork body 10 and sleeve 12 assembly may be inserted into the neck of a filled bottle 36 with a standard corker. The mini gas cartridge assembly may then be inserted into the sleeve 12 and threaded into the cork outside the end of the sleeve 12 by about a turn or two. The knob top 34 and its decorative skirt 32 may mask the assembly and, in some embodiments, may resemble a dripping wax seal. The knob top 34 and the decorative skirt 32 may sit above the neck of the bottle by about the same length as the remaining cork body 10 that lies beyond the sleeve 12. The knob top 34 may include a countersunk sealer 54 configured to seal the bottle cork into the bottle 36.

To remove the cork, the knob top 34 may be turned clockwise while pushing down, rotating the mini-corkscrew 16 and its associated mini gas cartridge assembly inside the sleeve and further into the cork body 10 that is below and outside of the sleeve 12. This bottom portion of the cork body 10 may have contact with the beverage 38, such as wine, being stored within the bottle 36. The corkscrew end 18 may penetrate the cork body 10 and come to rest level with the bottom surface 42 of the cork body 10, breaking a hole or fissure therein, As the corkscrew end 18 bottoms out at the base of the sleeve 12 and stops turning, the threaded end 20 with the puncture nipple 22 may begin to thread inside the threaded collar 24, wherein the puncture nipple 22 may be drawn into and through the seal 28 on the gas cartridge 26, releasing gas 40 through a gas release channel 46 that extends through the mini-corkscrew 16, exiting the mini-corkscrew 16 and the pierced cork body 10 and flowing into the cavity between the beverage 38 and the bottom of the cork body 10. The resulting pressure may push the bottle cork out of the bottle 36 and into a user's hand.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A bottle cork with a built-in removal mechanism, the bottle cork comprising:

a cork body having a substantially hollow sleeve positioned therein, the hollow sleeve configured to accommodate a mini-corkscrew within the hollow sleeve, the mini-corkscrew comprising a corkscrew end extending toward a bottom surface of the cork body and an end opposite the corkscrew end;

a gas cartridge configured to be punctured by the end of the mini-corkscrew opposite the corkscrew end; and a knob top attached to the gas cartridge, such that when the knob top is rotated, the gas cartridge is pierced by the end of the mini-corkscrew opposite the corkscrew end while the corkscrew end is drawn into the cork body and through the bottom surface of the cork body, wherein the pressure exerted by the pierced gas cartridge forces the bottle cork out of a bottle.

2. The bottle cork of claim 1, further comprising a threaded collar attached to an end of the gas cartridge proximate to the mini-corkscrew.

3. The bottle cork of claim 2, wherein the mini-corkscrew comprises:

the corkscrew end; and a threaded end with a puncture nipple opposite the corkscrew end, the threaded end configured to engage with the threaded collar.

4. The bottle cork of claim 3, wherein the puncture nipple is aligned with a rupturable gas cartridge seal on the gas cartridge, such that when the knob top is rotated, the threaded end engages with the threaded collar and the puncture nipple contacts and ruptures the gas cartridge seal.

5. The bottle cork of claim 2, further comprising a safety clip securing the sleeve, the threaded collar, and the mini-corkscrew within the cork body.

6. The bottle cork of claim 1, wherein the knob top is configured to be removably sealed to an outer surface of the bottle.

7. The bottle cork of claim 6, wherein a decorative skirt with a tear tab extends from the knob top down a length of a neck of the bottle.

8. The bottle cork of claim 1, further comprising a countersunk sealer positioned within the knob top.

9. A bottle cork with a built-in removal mechanism, the bottle cork comprising:

a cork body having a substantially hollow sleeve positioned therein, the hollow sleeve configured to accommodate a mini-corkscrew within the hollow sleeve, the mini-corkscrew comprising a corkscrew end extending toward a bottom surface of the cork body and a threaded end with a puncture nipple opposite the corkscrew end;

a gas cartridge comprising a threaded collar configured to engage with the threaded end and a rupturable gas cartridge seal configured to be punctured by the puncture nipple;

a knob top attached to the gas cartridge, such that when the knob top is rotated, the gas cartridge is pierced by the puncture nipple while the corkscrew end is drawn into the cork body and through the bottom surface of the cork body; and a gas release channel extending through the mini-corkscrew, wherein:

when the gas cartridge is pierced, gas from the gas cartridge is released and flows through the gas release channel into a bottle, forcing the bottle cork out of the bottle.

10. The bottle cork of claim 9, further comprising a safety clip securing the sleeve, the threaded collar, and the mini-corkscrew within the cork body.

* * * * *